US005897436A

United States Patent [19]

Singer et al.

[11] Patent Number: 5,897,436

[45] Date of Patent: Apr. 27, 1999

[54] MODIFIED POKER CARD GAME

[75] Inventors: Anthony M. Singer, Brooklyn, N.Y.; Howard M. Marks, Westport, Conn.

[73] Assignee: PTT, LLC, Westport, Conn.

[21] Appl. No.: 08/859,365

[22] Filed: May 20, 1997

Related U.S. Application Data

[62] Division of application No. 08/716,114, Sep. 19, 1996, Pat. No. 5,755,621

[60] Provisional application No. 60/019,747, Jun. 14, 1996.

[51] Int. Cl.[6] ..... A63F 9/22

[52] U.S. Cl. ..... 273/293; 273/303; 463/12; 463/11

[58] Field of Search ..... 463/1, 11–13, 463/16, 25, 29, 30–31, 36, 40–42; 273/292–293, 139, 303, 138.1–138.2

[56] References Cited

U.S. PATENT DOCUMENTS

| | | |
|---|---|---|
| 4,275,442 | 6/1981 | Underwood et al. . |
| 4,743,022 | 5/1988 | Wood . |
| 4,837,728 | 6/1989 | Barrie et al. . |
| 4,842,275 | 6/1989 | Tsatskin . |
| 4,856,787 | 8/1989 | Itkis . |
| 4,875,686 | 10/1989 | Timms . |
| 4,926,327 | 5/1990 | Sidley . |
| 4,948,134 | 8/1990 | Suttle et al. . |
| 5,013,049 | 5/1991 | Tomaszewski . |
| 5,078,405 | 1/1992 | Jones et al. . |
| 5,083,271 | 1/1992 | Thacher et al. . |
| 5,100,137 | 3/1992 | Fulton . |
| 5,118,109 | 6/1992 | Gumina . |
| 5,198,976 | 3/1993 | Form et al. . |
| 5,200,890 | 4/1993 | Pionchon . |
| 5,218,631 | 6/1993 | Katz . |
| 5,242,163 | 9/1993 | Fulton . |
| 5,255,915 | 10/1993 | Miller . |
| 5,275,400 | 1/1994 | Weingardt et al. . |
| 5,280,426 | 1/1994 | Edmonds . |
| 5,294,128 | 3/1994 | Marquez . |
| 5,314,194 | 5/1994 | Wolf . |
| 5,328,189 | 7/1994 | Malek . |
| 5,349,633 | 9/1994 | Katz . |
| 5,359,510 | 10/1994 | Sabaliauskas . |
| 5,368,305 | 11/1994 | Rodda et al. . |
| 5,382,025 | 1/1995 | Sklansky et al. . |
| 5,393,057 | 2/1995 | Marnell, II . |
| 5,393,067 | 2/1995 | Paulsen et al. . |
| 5,393,074 | 2/1995 | Bear et al. . |
| 5,407,199 | 4/1995 | Gumina . |
| 5,415,404 | 5/1995 | Joshi et al. . |
| 5,431,407 | 7/1995 | Hofberg et al. . |
| 5,437,451 | 8/1995 | Fulton . |
| 5,451,054 | 9/1995 | Orenstein . |
| 5,531,440 | 7/1996 | Dabrowski et al. . |
| 5,531,441 | 7/1996 | Dabrowski et al. . |
| 5,542,669 | 8/1996 | Charron et al. . |
| 5,544,892 | 8/1996 | Breeding . |
| 5,548,485 | 8/1996 | Jones et al. . |
| 5,586,257 | 12/1996 | Perlman . |
| 5,591,081 | 1/1997 | Suzuki . |
| 5,601,488 | 2/1997 | Kadlic . |
| 5,603,502 | 2/1997 | Nakagawa . |
| 5,605,504 | 2/1997 | Huang . |
| 5,611,730 | 3/1997 | Weiss . |
| 5,618,045 | 4/1997 | Kagan et al. . |
| 5,618,232 | 4/1997 | Martin . |
| 5,626,341 | 5/1997 | Jones et al. . |
| 5,630,586 | 5/1997 | Lowden . |
| 5,639,088 | 6/1997 | Schneider et al. . |
| 5,643,088 | 7/1997 | Vaughn et al. . |
| 5,647,795 | 7/1997 | Stanton . |
| 5,655,961 | 8/1997 | Acres et al. . |

*Primary Examiner*—Jessica J. Harrison
*Assistant Examiner*—Mark A Sager
*Attorney, Agent, or Firm*—Irah H. Donner; Pepper Hamilton LLP

[57] ABSTRACT

A modified poker card game allows a player to sequentially build a card hand after each round of play. The rules of play for the card game including dealing a first pair of cards to the player. The player then selects one of the pair of cards for the card hand, and discards the other card. The player repeats this process until the player has selected a predetermined number of cards that form the card hand. The resulting card hand is then compared to a predetermined winning schedule and/or to other players playing the modified poker game.

7 Claims, 22 Drawing Sheets

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

| COINS PLAYED | 1ST | 2ND | 3RD | 4TH | 5TH |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| PAIR TENS OR BETTER | 1 | 2 | 3 | 4 | 5 |

VIDEO POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | PAYOFF 6 COINS | RECOMMENDED TOTAL PAYOFF 4 COINS |
|---|---|---|---|---|---|---|---|
| JACKS OR BETTER | 21,820,000 | 1 | 21,820,000 | 2 | 43,640,000 | 3 | 65,480,000 |
| TWO PAIR | 12,880,000 | 3 | 38,640,000 | 6 | 77,280,000 | 9 | 115,920,000 |
| THREE OF A KIND | 7,470,000 | 5 | 37,350,000 | 10 | 74,700,000 | 15 | 112,050,000 |
| STRAIGHT | 1,180,000 | 15 | 17,700,000 | 30 | 35,400,000 | 45 | 53,100,000 |
| FLUSH | 1,070,000 | 20 | 21,400,000 | 40 | 42,800,000 | 60 | 64,200,000 |
| FULL HOUSE | 1,150,000 | 30 | 34,500,000 | 60 | 69,000,000 | 90 | 103,500,000 |
| FOUR OF A KIND | 240,000 | 75 | 18,000,000 | 150 | 36,000,000 | 225 | 54,000,000 |
| STRAIGHT FLUSH | 10,000 | 200 | 2,000,000 | 400 | 4,000,000 | 600 | 6,000,000 |
| ROYAL FLUSH | 2,500 | 750 | 1,875,000 | 4000 | 10,000,000 | 6000 | 15,000,000 |
| | 45,822,500 | | 153,285,000 | | 352,820,000 | | 589,230,000 |
| | | TOTAL COINS IN | 200,000,000 | TOTAL COINS IN | 400,000,000 | TOTAL COINS IN | 600,000,000 |
| | | HOLD PERCENT | 0.033575 | HOLD PERCENT | 0.01736 | HOLD PERCENT | 0.01735 |

FIG. 15A

VIDEO POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | PAYOFF 6 COINS | RECOMMENDED TOTAL PAYOFF 4 COINS |
|---|---|---|---|---|---|---|---|
| JACKS OR BETTER | 21,820,000 | 1 | 21,820,000 | 2 | 43,640,000 | 3 | 65,460,000 |
| TWO PAIR | 12,880,000 | 3 | 38,640,000 | 6 | 77,280,000 | 9 | 115,920,000 |
| THREE OF A KIND | 7,470,000 | 5 | 37,350,000 | 10 | 74,700,000 | 15 | 112,050,000 |
| STRAIGHT | 1,180,000 | 15 | 17,700,000 | 30 | 35,400,000 | 45 | 53,100,000 |
| FLUSH | 1,070,000 | 20 | 21,400,000 | 40 | 42,800,000 | 60 | 64,200,000 |
| FULL HOUSE | 1,150,000 | 25 | 28,750,000 | 50 | 57,500,000 | 75 | 86,250,000 |
| FOUR OF A KIND | 240,000 | 75 | 18,000,000 | 150 | 36,000,000 | 225 | 54,000,000 |
| STRAIGHT FLUSH | 10,000 | 200 | 2,000,000 | 400 | 4,000,000 | 600 | 6,000,000 |
| ROYAL FLUSH | 2,500 | 750 | 1,875,000 | 4000 | 10,000,000 | 6000 | 15,000,000 |
| | 45,822,500 | | 187,535,000 | | 381,320,000 | | 571,980,000 |
| | | TOTAL COINS IN | 200,000,000 | TOTAL COINS IN | 400,000,000 | TOTAL COINS IN | 600,000,000 |
| | | HOLD PERCENT | 0.062325 | HOLD PERCENT | 0.0467 | HOLD PERCENT | 0.0467 |

FIG. 15B

VIDEO POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | PAYOFF 6 COINS | RECOMMENDED TOTAL PAYOFF 4 COINS |
|---|---|---|---|---|---|---|---|
| JACKS OR BETTER | 21,820,000 | 1 | 21,820,000 | 2 | 43,640,000 | 3 | 65,460,000 |
| TWO PAIR | 12,880,000 | 3 | 38,640,000 | 6 | 77,280,000 | 9 | 115,920,000 |
| THREE OF A KIND | 7,470,000 | 5 | 37,350,000 | 10 | 74,700,000 | 15 | 112,050,000 |
| STRAIGHT | 1,180,000 | 15 | 17,700,000 | 30 | 35,400,000 | 45 | 53,100,000 |
| FLUSH | 1,070,000 | 18 | 19,260,000 | 36 | 38,520,000 | 54 | 57,780,000 |
| FULL HOUSE | 1,150,000 | 21 | 24,150,000 | 42 | 48,300,000 | 63 | 72,450,000 |
| FOUR 0F A KIND | 240,000 | 75 | 18,000,000 | 150 | 36,000,000 | 225 | 54,000,000 |
| STRAIGHT FLUSH | 10,000 | 200 | 2,000,000 | 400 | 4,000,000 | 600 | 6,000,000 |
| ROYAL FLUSH | 2,500 | 750 | 1,875,000 | 4000 | 10,000,000 | 6000 | 15,000,000 |
| | 45,822,500 | | 180,735,000 | | 367,840,000 | | 551,760,000 |
| | | TOTAL COINS IN | 200,000,000 | TOTAL COINS IN | 400,000,000 | TOTAL COINS IN | 600,000,000 |
| | | HOLD PERCENT | 0.036025 | HOLD PERCENT | 0.0804 | HOLD PERCENT | 0.0804 |

FIG. 15C

VIDEO POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | HIGH VALUE BONUS PAYOFF 6 COINS | HIGH VALUE BONUS TOTAL PAYOFF 6 COINS |
|---|---|---|---|---|---|---|---|
| JACKS OR BETTER | 21,820,000 | 1 | 21,820,000 | 2 | 43,640,000 | 3 | 65,460,000 |
| TWO PAIR | 12,880,000 | 3 | 38,640,000 | 6 | 77,280,000 | 9 | 115,920,000 |
| THREE OF A KIND | 7,470,000 | 5 | 37,350,000 | 10 | 74,700,000 | 15 | 112,050,000 |
| STRAIGHT | 1,180,000 | 12 | 14,160,000 | 24 | 28,320,000 | 36 | 42,480,000 |
| FLUSH | 1,070,000 | 16 | 17,120,000 | 32 | 34,240,000 | 48 | 51,360,000 |
| FULL HOUSE | 1,150,000 | 20 | 23,000,000 | 40 | 46,000,000 | 60 | 69,000,000 |
| FOUR OF A KIND | 240,000 | 150 | 36,000,000 | 300 | 72,000,000 | 450 | 108,000,000 |
| STRAIGHT FLUSH | 10,000 | 400 | 4,000,000 | 800 | 8,000,000 | 1200 | 12,000,000 |
| ROYAL FLUSH | 2,500 | 1200 | 3,000,000 | 4000 | 10,000,000 | 6000 | 15,000,000 |
| | 45,822,500 | | 195,090,000 | | 394,180,000 | | 591,270,000 |
| | | TOTAL COINS IN | 200,000,000 | TOTAL COINS IN | 400,000,000 | TOTAL COINS IN | 600,000,000 |
| | | HOLD PERCENT | 0.02455 | HOLD PERCENT | 0.01455 | HOLD PERCENT | 0.01455 |

FIG. 16A

VIDEO POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | HIGH VALUE BONUS PAYOFF 6 COINS | HIGH VALUE BONUS TOTAL PAYOFF 6 COINS |
|---|---|---|---|---|---|---|---|
| JACKS OR BETTER | 21,820,000 | 1 | 21,820,000 | 2 | 43,640,000 | 3 | 65,460,000 |
| TWO PAIR | 12,880,000 | 3 | 38,640,000 | 6 | 77,280,000 | 9 | 115,920,000 |
| THREE OF A KIND | 7,470,000 | 5 | 37,350,000 | 10 | 74,700,000 | 15 | 112,050,000 |
| STRAIGHT | 1,180,000 | 10 | 11,800,000 | 20 | 23,600,000 | 30 | 35,400,000 |
| FLUSH | 1,070,000 | 14 | 14,980,000 | 28 | 29,960,000 | 42 | 44,940,000 |
| FULL HOUSE | 1,150,000 | 18 | 20,700,000 | 36 | 41,400,000 | 54 | 62,100,000 |
| FOUR OF A KIND | 240,000 | 150 | 36,000,000 | 300 | 72,000,000 | 450 | 108,000,000 |
| STRAIGHT FLUSH | 10,000 | 400 | 4,000,000 | 800 | 8,000,000 | 1200 | 12,000,000 |
| ROYAL FLUSH | 2,500 | 1200 | 3,000,000 | 4000 | 10,000,000 | 6000 | 15,000,000 |
| | 45,822,500 | | 188,290,000 | | 380,580,000 | | 570,870,000 |
| | | TOTAL COINS IN | 200,000,000 | TOTAL COINS IN | 400,000,000 | TOTAL COINS IN | 600,000,000 |
| | | HOLD PERCENT | 0.05855 | HOLD PERCENT | 0.04855 | HOLD PERCENT | 0.04855 |

FIG. 16B

VIDEO POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | HIGH VALUE BONUS PAYOFF 6 COINS | HIGH VALUE BONUS TOTAL PAYOFF 6 COINS |
|---|---|---|---|---|---|---|---|
| JACKS OR BETTER | 21,820,000 | 1 | 21,820,000 | 2 | 43,640,000 | 3 | 65,460,000 |
| TWO PAIR | 12,880,000 | 3 | 38,640,000 | 6 | 77,280,000 | 9 | 115,920,000 |
| THREE OF A KIND | 7,470,000 | 5 | 37,350,000 | 10 | 74,700,000 | 15 | 112,050,000 |
| STRAIGHT | 1,180,000 | 8 | 9,440,000 | 16 | 18,880,000 | 24 | 28,320,000 |
| FLUSH | 1,070,000 | 12 | 12,840,000 | 24 | 25,680,000 | 36 | 38,520,000 |
| FULL HOUSE | 1,150,000 | 18 | 20,700,000 | 36 | 41,400,000 | 54 | 62,100,000 |
| FOUR 0F A KIND | 240,000 | 150 | 36,000,000 | 300 | 72,000,000 | 450 | 108,000,000 |
| STRAIGHT FLUSH | 10,000 | 400 | 4,000,000 | 800 | 8,000,000 | 1200 | 12,000,000 |
| ROYAL FLUSH | 2,500 | 1200 | 3,000,000 | 4000 | 10,000,000 | 6000 | 15,000,000 |
| | 45,822,500 | | 183,790,000 | | 371,580,000 | | 557,370,000 |
| | | TOTAL COINS IN | 200,000,000 | TOTAL COINS IN | 400,000,000 | TOTAL COINS IN | 600,000,000 |
| | | HOLD PERCENT | 0.08105 | HOLD PERCENT | 0.07105 | HOLD PERCENT | 0.07105 |

FIG. 16C

RECOMMENDED

PICK'EM POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | PAYOFF 6 COINS | TOTAL PAYOFF 6 COINS |
|---|---|---|---|---|---|---|---|
| JACKS OR BETTER | 25,614,000 | 1 | 25,614,000 | 2 | 51,228,000 | 3 | 76,842,000 |
| TWO PAIR | 13,229,000 | 3 | 39,687,000 | 6 | 79,374,000 | 9 | 119,061,000 |
| THREE OF A KIND | 6,441,000 | 5 | 32,205,000 | 10 | 64,410,000 | 15 | 96,615,000 |
| STRAIGHT | 2,312,000 | 10 | 23,120,000 | 20 | 46,240,000 | 30 | 69,360,000 |
| FLUSH | 1,671,000 | 15 | 25,065,000 | 30 | 50,130,000 | 45 | 75,195,000 |
| FULL HOUSE | 1,075,000 | 25 | 26,875,000 | 50 | 53,750,000 | 75 | 80,625,000 |
| FOUR OF A KIND | 180,000 | 80 | 14,400,000 | 160 | 28,800,000 | 240 | 43,200,000 |
| STRAIGHT FLUSH | 26,000 | 200 | 5,200,000 | 400 | 10,400,000 | 600 | 15,600,000 |
| ROYAL FLUSH | 2,100 | 1000 | 2,100,000 | 4000 | 8,400,000 | 6000 | 12,600,000 |
| | 50,550,100 | | 194,266,000 | | 332,732,000 | | 583,038,000 |
| | | TOTAL COINS IN | 200,000,000 | TOTAL COINS IN | 400,000,000 | TOTAL COINS IN | 600,000,000 |
| | | HOLD PERCENT | 0.02867 | HOLD PERCENT | 0.01817 | HOLD PERCENT | 0.01817 |

FIG. 17A

RECOMMENDED

PICK'EM POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | PAYOFF 6 COINS | TOTAL PAYOFF 6 COINS |
|---|---|---|---|---|---|---|---|
| JACKS OR BETTER | 25,614,000 | 1 | 25,614,000 | 2 | 51,228,000 | 3 | 76,842,000 |
| TWO PAIR | 13,229,000 | 3 | 39,687,000 | 6 | 79,374,000 | 9 | 119,061,000 |
| THREE OF A KIND | 6,441,000 | 5 | 32,205,000 | 10 | 64,410,000 | 15 | 96,615,000 |
| STRAIGHT | 2,312,000 | 10 | 23,120,000 | 20 | 46,240,000 | 30 | 69,360,000 |
| FLUSH | 1,671,000 | 15 | 25,065,000 | 30 | 50,130,000 | 45 | 75,195,000 |
| FULL HOUSE | 1,075,000 | 20 | 21,500,000 | 40 | 43,000,000 | 60 | 64,500,000 |
| FOUR OF A KIND | 180,000 | 80 | 14,400,000 | 160 | 28,800,000 | 240 | 43,200,000 |
| STRAIGHT FLUSH | 26,000 | 200 | 5,200,000 | 400 | 10,400,000 | 600 | 15,600,000 |
| ROYAL FLUSH | 2,100 | 1000 | 2,100,000 | 4000 | 8,400,000 | 6000 | 12,600,000 |
| | 50,550,100 | | 188,851,000 | | 381,382,000 | | 572,973,000 |
| | | TOTAL COINS IN | 200,000,000 | TOTAL COINS IN | 400,000,000 | TOTAL COINS IN | 600,000,000 |
| | | HOLD PERCENT | 0.055545 | HOLD PERCENT | 0.046045 | HOLD PERCENT | 0.045045 |

FIG. 17B

PICK' EM POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | PAYOFF 6 COINS | RECOMMENDED TOTAL PAYOFF 6 COINS |
|---|---|---|---|---|---|---|---|
| JACKS OR BETTER | 25,614,000 | 1 | 25,614,000 | 2 | 51,228,000 | 3 | 76,842,000 |
| TWO PAIR | 13,229,000 | 3 | 39,687,000 | 6 | 79,374,000 | 9 | 119,061,000 |
| THREE OF A KIND | 6,441,000 | 5 | 32,205,000 | 10 | 64,410,000 | 15 | 96,615,000 |
| STRAIGHT | 2,312,000 | 10 | 23,120,000 | 20 | 46,240,000 | 30 | 69,360,000 |
| FLUSH | 1,671,000 | 12 | 20,052,000 | 24 | 40,104,000 | 36 | 60,156,000 |
| FULL HOUSE | 1,075,000 | 18 | 19,350,000 | 36 | 38,700,000 | 54 | 58,050,000 |
| FOUR 0F A KIND | 180,000 | 80 | 14,400,000 | 160 | 28,800,000 | 240 | 43,200,000 |
| STRAIGHT FLUSH | 26,000 | 200 | 5,200,000 | 400 | 10,400,000 | 600 | 15,600,000 |
| ROYAL FLUSH | 2,100 | 1000 | 2,100,000 | 4000 | 8,400,000 | 6000 | 12,600,000 |
| | 50,550,100 | | 181,728,000 | | 367,656,000 | | 551,484,000 |
| | | TOTAL COINS IN | 200,000,000 | TOTAL COINS IN | 400,000,000 | TOTAL COINS IN | 600,000,000 |
| | | HOLD PERCENT | 0.09136 | HOLD PERCENT | 0.08086 | HOLD PERCENT | 0.08086 |

FIG. 17C

PICK'EM POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | HIGH VALUE BONUS PAYOFF 6 COINS | HIGH VALUE BONUS TOTAL PAYOFF 6 COINS |
|---|---|---|---|---|---|---|---|
| JACKS OR BETTER | 25,614,000 | 1 | 25,614,000 | 2 | 51,228,000 | 3 | 76,842,000 |
| TWO PAIR | 13,229,000 | 3 | 39,687,000 | 6 | 79,374,000 | 9 | 119,061,000 |
| THREE OF A KIND | 6,441,000 | 5 | 32,205,000 | 10 | 64,410,000 | 15 | 96,615,000 |
| STRAIGHT | 2,312,000 | 10 | 23,120,000 | 20 | 46,240,000 | 30 | 69,360,000 |
| FLUSH | 1,671,000 | 15 | 25,065,000 | 30 | 50,130,000 | 45 | 75,195,000 |
| FULL HOUSE | 1,075,000 | 20 | 21,500,000 | 40 | 43,000,000 | 60 | 64,500,000 |
| FOUR OF A KIND | 180,000 | 100 | 18,000,000 | 200 | 36,000,000 | 300 | 54,000,000 |
| STRAIGHT FLUSH | 26,000 | 300 | 7,800,000 | 600 | 15,600,000 | 900 | 23,400,000 |
| ROYAL FLUSH | 2,100 | 1000 | 2,100,000 | 4000 | 8,400,000 | 6000 | 12,600,000 |
| | 50,550,100 | | 195,091,000 | | 394,382,000 | | 591,573,000 |
| | | TOTAL COINS IN | 200,000,000 | TOTAL COINS IN | 400,000,000 | TOTAL COINS IN | 600,000,000 |
| | | HOLD PERCENT | 0.024545 | HOLD PERCENT | 0.014045 | HOLD PERCENT | 0.014045 |

FIG. 18A

PICK'EM POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | HIGH VALUE BONUS PAYOFF 6 COINS | HIGH VALUE BONUS TOTAL PAYOFF 6 COINS |
|---|---|---|---|---|---|---|---|
| JACKS OR BETTER | 25,614,000 | 1 | 25,614,000 | 2 | 51,228,000 | 3 | 76,842,000 |
| TWO PAIR | 13,229,000 | 3 | 39,687,000 | 6 | 79,374,000 | 9 | 119,061,000 |
| THREE OF A KIND | 6,441,000 | 5 | 32,205,000 | 10 | 64,410,000 | 15 | 96,615,000 |
| STRAIGHT | 2,312,000 | 10 | 23,120,000 | 20 | 46,240,000 | 30 | 69,360,000 |
| FLUSH | 1,671,000 | 14 | 23,394,000 | 28 | 46,788,000 | 42 | 70,182,000 |
| FULL HOUSE | 1,075,000 | 18 | 19,350,000 | 36 | 38,700,000 | 54 | 58,050,000 |
| FOUR OF A KIND | 180,000 | 100 | 18,000,000 | 200 | 36,000,000 | 300 | 54,000,000 |
| STRAIGHT FLUSH | 26,000 | 300 | 7,800,000 | 600 | 15,600,000 | 900 | 23,400,000 |
| ROYAL FLUSH | 2,100 | 1000 | 2,100,000 | 4000 | 8,400,000 | 6000 | 12,600,000 |
| | 50,550,100 | | 191,270,000 | | 386,740,000 | | 580,110,000 |
| | | TOTAL COINS IN | 200,000,000 | TOTAL COINS IN | 400,000,000 | TOTAL COINS IN | 600,000,000 |
| | | HOLD PERCENT | 0.04365 | HOLD PERCENT | 0.03315 | HOLD PERCENT | 0.03315 |

FIG. 18B

PICK 'EM POKER: EVEN COIN PAYOFF TABLE WITH A BETTER DISTRIBUTION OF RETURNS

| DESCRIPTION | OCCURENCES | PAYOFF 2 COINS | TOTAL PAYOFF 2 COINS | PAYOFF 4 COINS | TOTAL PAYOFF 4 COINS | PAYOFF 6 COINS | HIGH VALUE BONUS TOTAL PAYOFF 6 COINS |
|---|---|---|---|---|---|---|---|
| JACKS OR BETTER | 25,614,000 | 1 | 25,614,000 | 2 | 51,228,000 | 3 | 76,842,000 |
| TWO PAIR | 13,229,000 | 3 | 39,687,000 | 6 | 79,374,000 | 9 | 119,061,000 |
| THREE OF A KIND | 6,441,000 | 5 | 32,205,000 | 10 | 64,410,000 | 15 | 96,615,000 |
| STRAIGHT | 2,312,000 | 8 | 18,496,000 | 16 | 36,992,000 | 24 | 55,488,000 |
| FLUSH | 1,671,000 | 12 | 20,052,000 | 24 | 40,104,000 | 36 | 60,156,000 |
| FULL HOUSE | 1,075,000 | 18 | 19,350,000 | 36 | 38,700,000 | 54 | 58,050,000 |
| FOUR 0F A KIND | 180,000 | 100 | 18,000,000 | 200 | 36,000,000 | 300 | 54,000,000 |
| STRAIGHT FLUSH | 26,000 | 300 | 7,800,000 | 600 | 15,600,000 | 900 | 23,400,000 |
| ROYAL FLUSH | 2,100 | 1000 | 2,100,000 | 4000 | 8,400,000 | 6000 | 12,600,000 |
| | 50,550,100 | | 183,304,000 | | 367,808,000 | | 556,212,000 |
| | | TOTAL COINS IN | 200,000,000 | TOTAL COINS IN | 400,000,000 | TOTAL COINS IN | 600,000,000 |
| | | HOLD PERCENT | 0.08348 | HOLD PERCENT | 0.07298 | HOLD PERCENT | 0.07298 |

FIG. 18C

MODIFIED POKER CARD GAME

RELATED APPLICATIONS

This application claims priority from provisional patent application Ser. No. 60/019,747, filed Jun. 14, 1996, and is a divisional application of Ser. No. 08/716,114, filed Sep. 19, 1996, now U.S. Pat. No. 5,755,621 incorporated herein by reference.

TECHNICAL FIELD

The present invention relates generally to games, and more particularly, to a modified poker card game. In the modified poker card game computer system, a player plays the game against the "house" or computer system. Special features are provided to enhance game play.

BACKGROUND ART

The growth of the gaming industry, in particular, gambling casinos has been very significant over the last decade. The industry has come to recognize the need for new games and new gambling concepts. It also recognizes that the new technologies available need to be integrated in order to improve their gaming environment. It also recognizes the need to become a more efficient gaming provider.

The state gaming control boards of Nevada and New Jersey (which have traditionally been slow to approve any new games or gambling concepts) have changed their philosophy so dramatically that today they actively encourage the trial and acceptance of new games and gambling concepts. The problem with introducing new games has always been the basic criteria for mass-market gambling:

Easy-to-learn game rules.

Strategies must be easy to master and not favor "the expert" disproportionately.

Games must have a short duration between the start (the bet) and the finish (the payoff).

The payoff structure, that is, what can be won by a lucky player must be enticing.

The game must be fair, that is, the casino should not have an unreasonable advantage.

The game must be "secure", that is, protected from cheating and tampering.

The casino's "win" must be demonstrated to be worthwhile., that is, the "win per machine per month" must at least compare favorably to that of the "slots".

Over the years, there have been many different types of games that have attempted to satisfy the demands of the gaming industry. These games have ranged the gamut from those involving great mental prowess to games involving merely chance. Nevertheless, there is still a strong interest in game concepts that create real excitement.

More specifically, with many games the players are placed in the position of passive observers. This is actually most true of the more expensive games that employ electronic components and the like which may or may not involve any skill on the part of the player. Still further, the game development or play is almost always viewed as unrealistic (e.g., only involving luck) at best.

Because of this fact, such expensive games are often difficult to market and discarded after minimal play even when purchased by the consumer. Moreover, even when use continues, such games have consistently lacked any relationship to the excitement as well as the strategy and planning that should be the characteristic of any game.

While it is generally recognized that decision making in game play is of paramount importance, there has yet to be a game that places players in a realistic decision making capacity.

One game of interest over the years is poker. Various attempts have been made to enhance play of poker over the years. Examples of such attempts are described in the following U.S. patent references, all of which are hereby incorporated by reference:

U.S. Pat No. 4,743,022, Wood, second chance poker method; U.S. Pat. No. 4,948,134, Suttle et al., electronic five card poker game where cards are given to the players one at a time; U.S. Pat. No. 5,013,049, Tomaszewski, five card poker game where up to two cards are drawn; U.S. Pat. No. 5,118,109 Gumina, instant poker game card; U.S. Pat. No. 5,255,915, Miller, six card, two hand video poker game; U.S. Pat. No. 5,294,128, Marquez, six cards, three hand poker game; U.S. Pat. No. 5,382,025, Sklansky et al., three hands, two card poker game where each player chooses one hand and five communal cards are dealt face up; U.S. Pat. No. 5,407,199, Gumina, interactive video/casino poker game-drawpoker, hold'em poker; U.S. Pat. No. 5,415,404, Joshi et al., multiplay video poker game in which the player's sub-hands are compensated to increase the payoff level of the winning hands; U.S. Pat. No. 5,431,407, Hofberg et al., casino poker game.

U.S. Pat. No. 5,437,451 to Fulton involves a modified poker game where the player is dealt pairs of cards, where one card is optional and the other mandatory. The player is permitted to exchange at each round the optional card until five cards are selected. The resulting five card hand is then evaluated for payoff against a fairly standard payoff table.

U.S. Pat. No. 5,314,194 to Wolf deals the player seven cards. The player then forms two hands: a five card hand (e.g., a front hand), and a two card hand (e.g., a back hand). The rules for playing this game are quite elaborate, including requiring each player to arrange the hand so that the rank of the back hand is greater than the rank of the front hand.

Unfortunately, all these prior art attempts at making poker interesting and challenging have not been successful. That is, the prior art has been unable to successfully provide a poker game that combines the attributes of skill, luck, excitement and simplicity with rapid play. For example, none of the prior art references cited above relate to dealing a player two exposed cards each round from which the player selects one card and discards the other card, or builds two simultaneous five card hands. Further, none of the above prior art references relate to building a poker-type hand one card at a time, at the selection/control of the player.

Accordingly, it is desirable to provide a modified poker game that provides a player the opportunity to exercise their skill. It is also desirable to provide a modified poker game that includes luck to make the game exciting, unpredictable and enjoyable for people of all levels of intelligence.

It is further desirable to provide a modified poker game that has simple rules so that new players may learn the game easily, including learning the appropriate strategy for the game.

It is also desirable to provide a modified poker game that can be played rapidly so that multiple games can be played between two or more players in a short period of time.

It is also desirable to provide a modified poker game that can be played between two players, or multiple players in a tournament manner.

It is further desirable to provide a modified poker game that incorporates the feature of providing bets of varying amounts the game value to further enhance the excitement of the game.

SUMMARY OF THE INVENTION

It is a feature and advantage of the present invention to provide a modified poker game that permits a player the opportunity to exercise their skill.

It is another feature and advantage of the present invention to provide a modified poker game that includes luck to make the game exciting, unpredictable and enjoyable for people of all levels of intelligence.

It is another feature and advantage of the present invention to provide a modified poker game that has simple rules so that new players may learn the game easily, including learning the appropriate strategy for the game.

It is a further feature and advantage of the present invention to provide a modified poker game that can be played rapidly so that multiple games can be played between two or more players in a short period of time.

It is another feature and advantage of the present invention to provide a modified poker game that can be played between two players, or multiple players in a tournament manner.

It is another feature and advantage of the present invention to provide a modified poker game that incorporates the feature of permitting different levels of game value to further enhance the excitement of the game.

It is another feature and advantage of the present invention to provide the player the option of playing the modified poker game against a computer in a slot machine fashion.

The present invention is based, in part, on the discovery or realization that previous attempts at improving the poker game have been unsuccessful due to the inability to combine the attributes of skill, luck, and simplicity with rapid play.

To achieve the features and advantages of the present invention, a game device providing a modified poker card game is provided as described below. The modified poker card game allows a player to sequentially build a card hand after each round of play. The rules of play for the card game including dealing a first pair of cards to the player. The player then selects one of the pair of cards for the card hand, and discards the other card. The player repeats this process until the player has selected a predetermined number of cards that form the card hand. The resulting card hand is then compared to a predetermined winning schedule and/or to other players playing the modified poker game.

In another embodiment of the invention, a method of playing a modified poker card game allows a player to sequentially build first and second card hands after each round of play. The method includes dealing a first pair of cards to the player, and having the player select one of the cards for the first card hand, and the other card for the second card hand. This process is repeatedly performed until the player has selected a predetermined number of cards for each of the first and second card hands. The resulting first and second card hands are then compared, together or independently, to a predetermined winning schedule and/or to other players hands.

These together with other objects and advantages which will be subsequently apparent, reside in the details of construction and operation as more fully herein described and claimed, with reference being had to the accompanying drawings forming a part hereof wherein like numerals refer to like elements throughout.

BRIEF DESCRIPTION OF THE DRAWINGS

FIGS. 15–16 are new payoff tables for a standard poker/video poker game; and FIGS. 17–18 are new payoff tables for use by the modified poker card game.

BEST MODE FOR CARRYING OUT THE INVENTION

The following describes the basic components and rules for playing the modified poker game. A card/video game (table game or video touch screen) with payoffs according to a predetermined payoff table is provided for a modified five card poker game. The lowest payoff is for two pairs of cards going up to royal straight flush. In a first version of the game, each player is given two exposed cards at a time from which the player selects one and discards the other. This process continues until each player has five cards. In other words, five pairs of cards are exposed from which the player chooses one each time trying to make the best poker hand possible. The discarded card is not shown again. The subsequently built five card hand is then evaluated for payoff.

In a second version of the game, instead of discarding the unselected card, two hands are constructed. That is, as each pair of cards are given to the player, the player creates two hands. In this version, the player is offered two cards per round, each round from which the player chooses one card for each hand. This process is continued for five rounds until the player has two hands of five cards each. Thus, at the end of the ten cards, two hands are constructed with five cards each. The payoff tables are predetermined according to the probability of constructing certain combinations of good hands from both of the two hands, not just one.

In general, for either the first or second versions of the game, five players, for example, can play the game together for amusement by exposing selected cards or no cards of the card hand. The players may play against each other for the best hand where the player with the best hand wins and collects the wagers of all other players in the hand. The game can also be utilized where all players play against the casino, a bank player, or against a payoff table.

Figure 1:
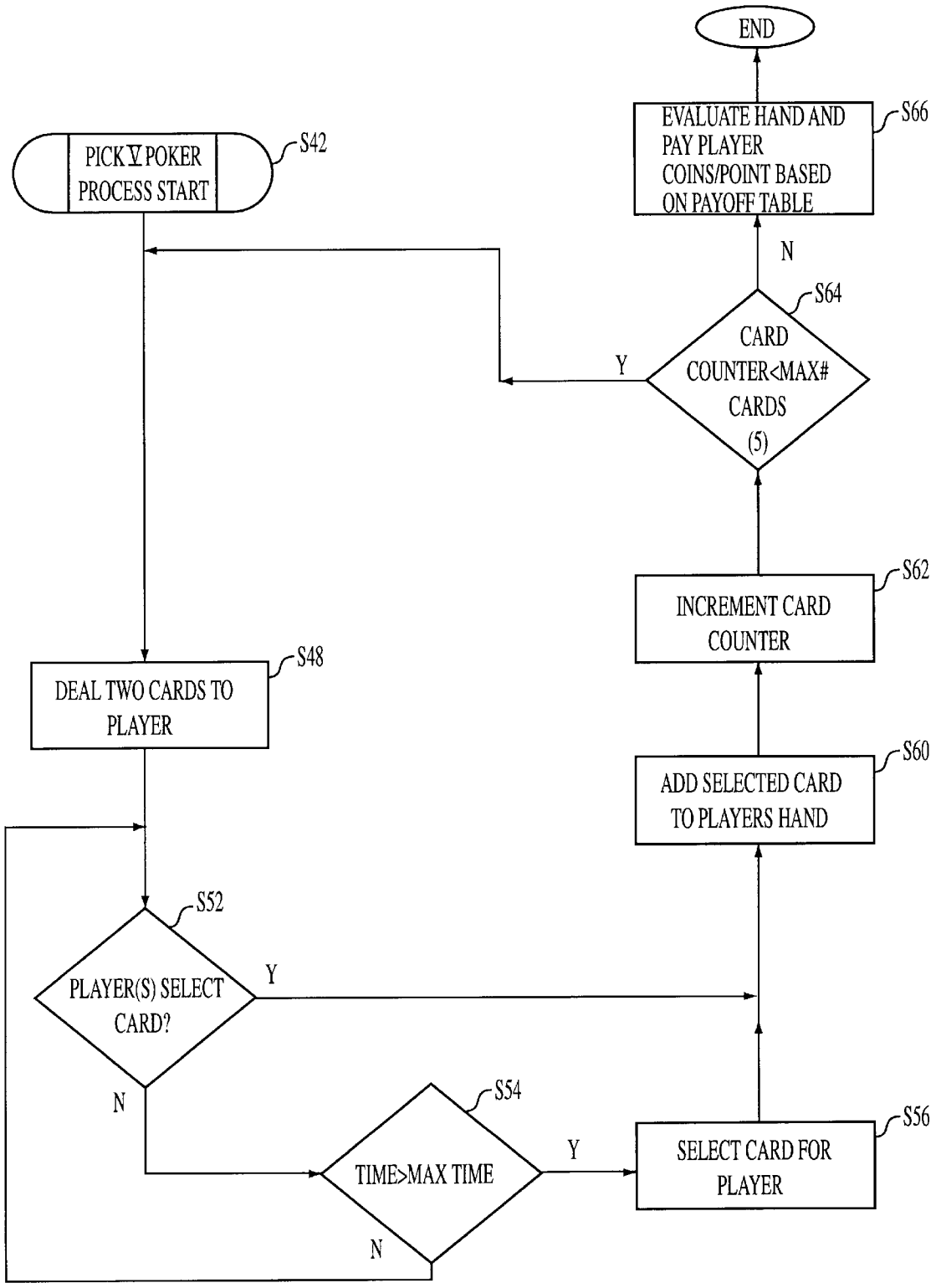
FIG. 1 is a flowchart of the modified poker card game rules.

FIG. 1 is a flowchart of the general rules/game process for the modified poker card game. In FIG. 1, the modified poker card process begins at Step S42. The game begins with the dealing the next set (e.g., pair or more) of cards in Step S48, so that the player can select, for example, one of the two cards to build the player's card hand. Other possibilities include all cards, no cards, and the like. It is then determined, for example, by the dealer, whether all players have selected, for example, one of the two cards which has been dealt to them in Step S52, and if not, determines whether a predetermined period of time has been exceeded which has been allocated for the player to choose a card in Step S54.

If the predetermined period of time has not been exceeded in Step S54, then the player(s) is monitored until the player(s) picks a card from each hand dealt to them. If the predetermined period of time has been exceeded in Step S54, then, optionally, a card is selected for the player from, for example, the pair of cards that has been dealt to the player in Step S56. The selected card is then added to the player's hand in Step S60.

An optional card counter is incremented in Step S62 indicating that the player(s) has accepted an additional card to build the player hand. The game station computer then determines whether the card counter is less than a maximum number of cards which has been allocated for the player hand in Step S64.

If the card counter is less than the maximum number of cards indicating that each of the players have not completed building their hands in Step S64, then the modified poker card game continues to deal additional cards to the player(s). If the card counter is not less than the maximum number of cards, i.e., the player has been dealt all cards required to build his hand in Step S64, then the complete player hand that has been built is evaluated in step S66. The player is then paid appropriate coins or points based on a predetermined payoff table which is utilized to determine whether the player's hand is successful or not in Step S66.

While FIG. 1 has described the general game rules for playing the modified poker card game with one or more players, other variations of the modified poker card game as possible as described below in detail. For example, players can play the modified poker game against each other, instead of against a predetermined payoff table. The modified poker card game can also be played on a computer or in tournament competition, as described below in detail.

Figure 2:
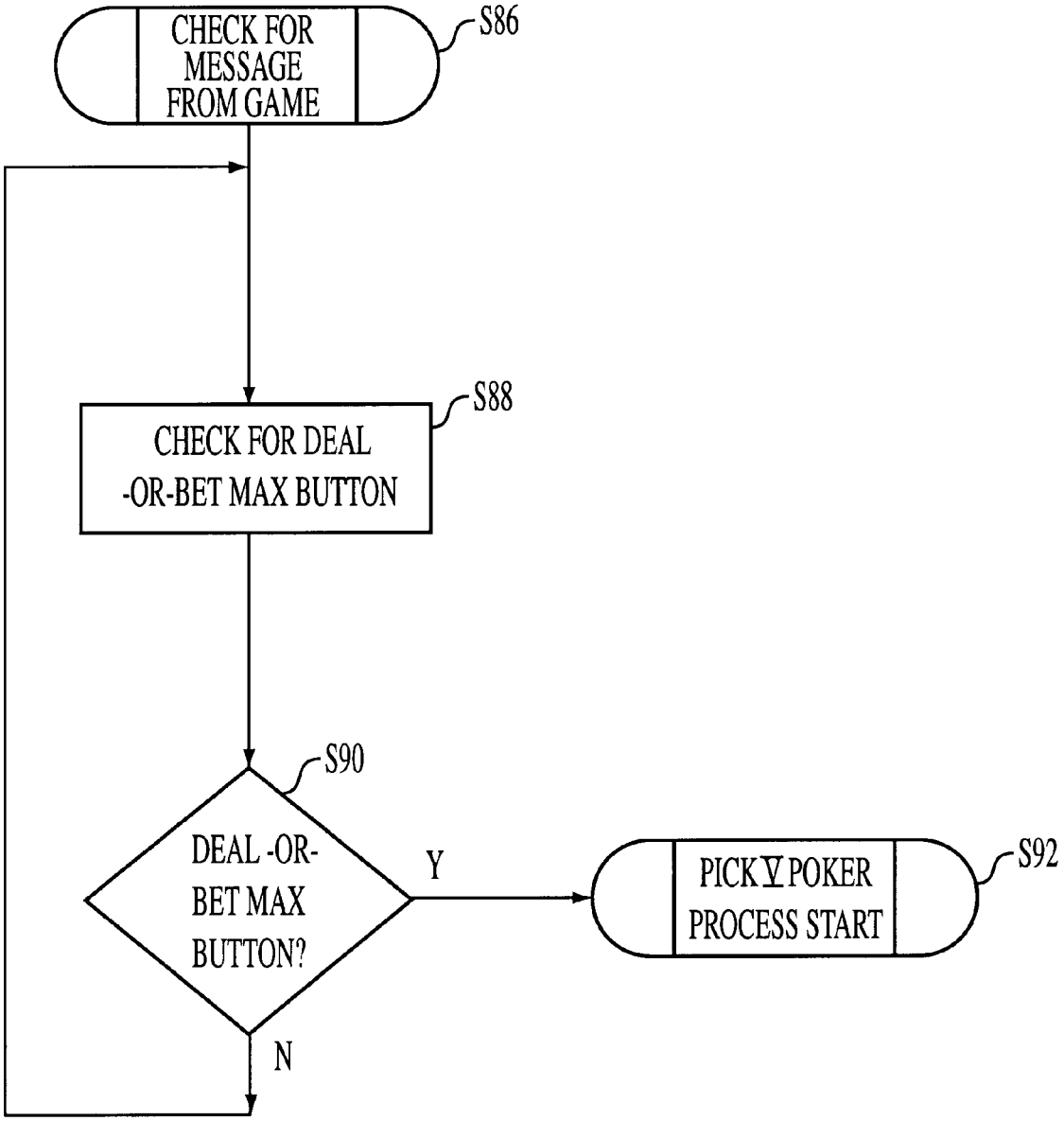
FIG. 2 is a flowchart of the modified poker card game rules when used on a standalone computer in a slot machine-like environment.

FIG. 2 is a flowchart of the modified poker card game rules when used on a standalone computer in a slot machine-like environment. In FIG. 2, the computer system (described below) determines whether the player has initiated a message in Step S86. If the computer system determines that the player is not waiting for the start of the next tournament, then the computer system checks for the activation of the deal or bet max button in Step S88 and determines whether either of those buttons have been activated in Step S90.

If computer system determines that the deal or bet max button has been activated in Step S90, then computer system reverts control to the beginning of the modified poker card process in Step S92 for implementation or execution of the modified poker game (see, e.g., FIG. 1). If the computer system determines that the deal or bet max button has not been activated in Step S90, then the computer system continues to check for activation of the deal or bet max button.

Figure 3:
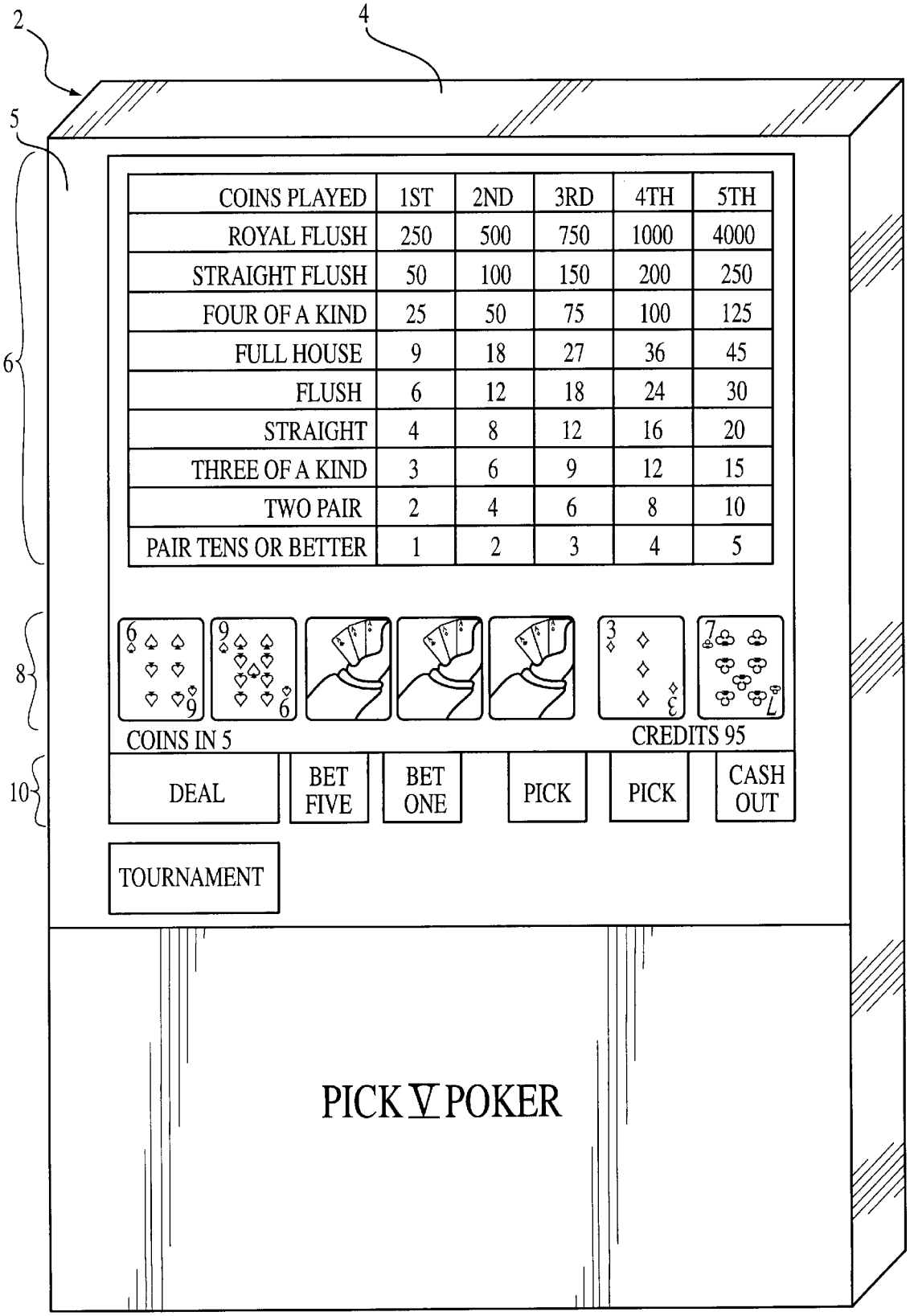
FIG. 3 is an illustration of the modified poker card game computer system illustrating a first game layout design displayed thereon.

FIG. 3 is an illustration of the modified poker game computer system with a first interface design illustrated thereon. In FIG. 3, modified poker game computer system 2 includes computer hardware and software as described below used to implement the modified poker card game. The computer hardware and software are included in computer 4 which can be any standard computer, such as a personal computer having a 486 microprocessor and standard hard disk drive accessories utilized in conjunction therewith. Computer 4 includes, preferably, computer display 5 having payoff or winning display area 6 and display area 8 for illustrating progression of the modified poker card game.

Computer display 5 also includes preferably display area 10 which is used for permitting the player to start and stop a game, select or choose the desired card, and to enter the appropriate wager. Display area 10 is preferably comprised of a standard touch screen area where the user can quickly enter the desired actions or selections. As can be readily seen in display area 10, the player has only 6 buttons or selections that are possible from the beginning of the game until the player chooses to terminate the game. These 6 buttons in display area 10 are described in greater detail below. Of course, other user interface/button designs may be utilized.

Figure 4:
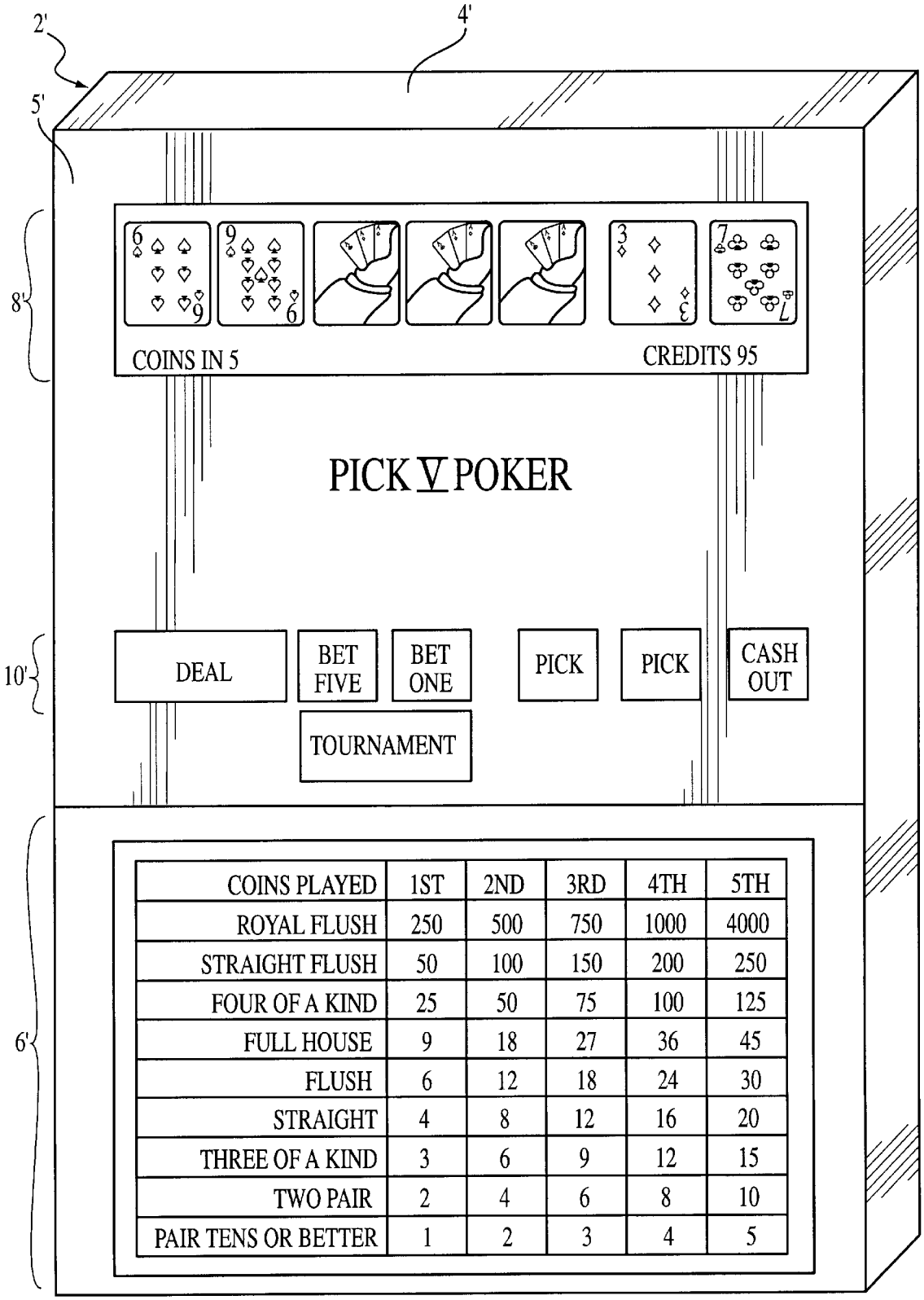
FIG. 4 is an illustration of the modified poker card game computer system illustrating a second game layout design displayed thereon.

FIG. 4 is an illustration of the modified poker game computer system in accordance with a second design layout. As illustrated in FIG. 4, the modified poker game computer system 2' includes modified computer system 4' with a modified computer display 5'. In computer system 4', the display 6' of possible winnings or "odds table" is displayed on the lower part of the computer system 4'. Display area 8' which illustrates the progression of the modified poker card game is disposed in an upper area of computer 4'. User interactive display area 10' is disposed in a similar location illustrated in FIG. 3.

Figure 5:
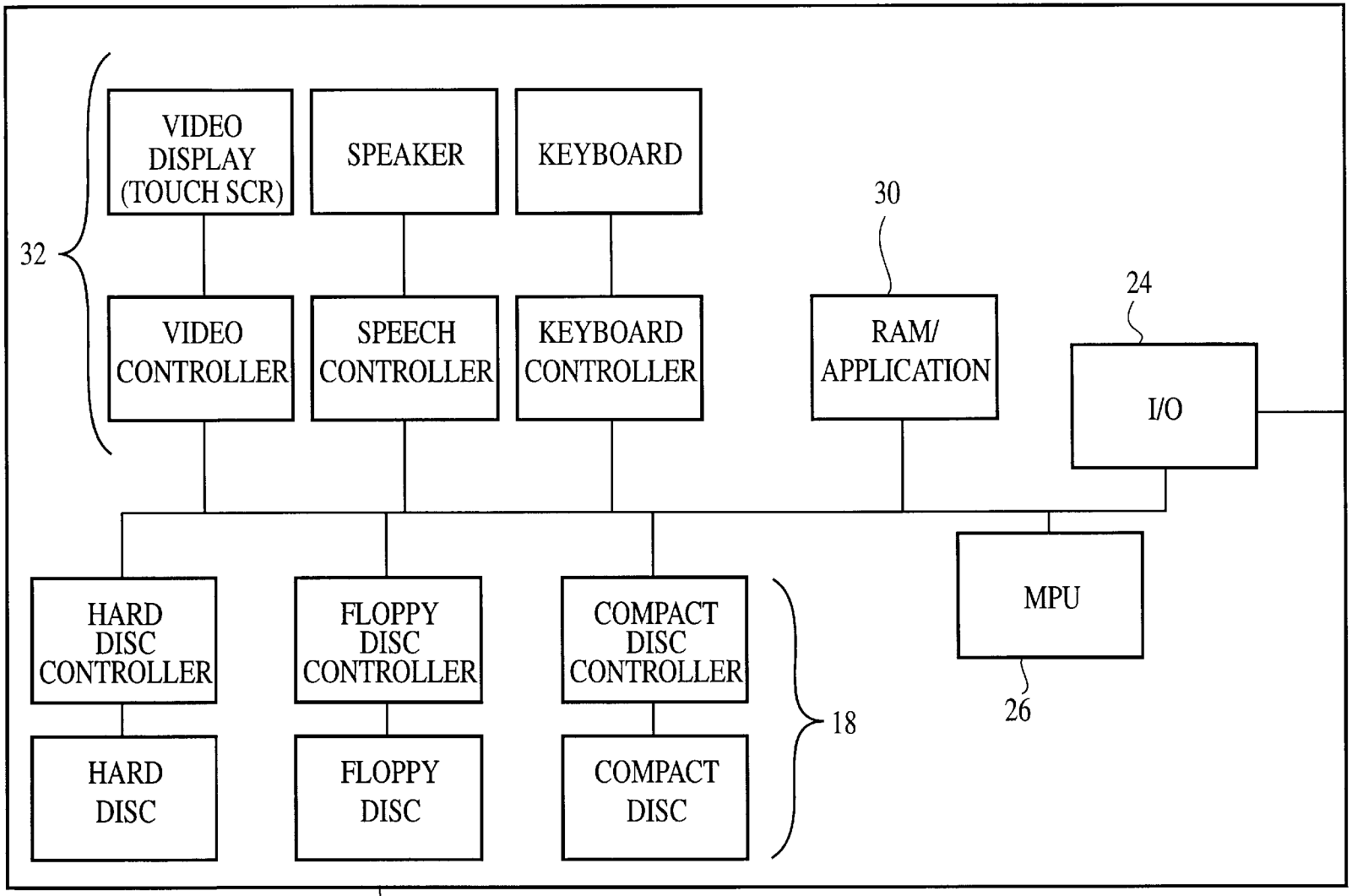
FIG. 5 is an illustration of the hardware used in the modified poker card game computer system.

FIG. 5 is an illustration of the hardware utilized in the modified poker game computer system. In FIG. 5, computer hardware 16 includes various storage devices 18 including hard disk drive, floppy disk drive and/or compact disk drive. Each of these storage devices includes a respective controller for controlling the reading of data from and/or writing of data to the various storage devices. Input/output (I/O) device 24 provides the gateway or connection from computer hardware 16 to possible external devices. For example, input/output device 24 may connect to other computers in a network environment. See, for example, U.S. Provisional Patents Ser. No. 60/011,574, filed Feb. 13, 1996, Ser. No. 60/011,573, filed Feb. 13, 1996, Ser. No. 60/013,798, filed Mar. 21, 1996, and Ser. No. 60/013,801, filed Mar. 21, 1996, incorporated herein by reference.

Main processing unit 26 performs the execution of the computer implemented functions for the modified poker game computer system. Computer hardware 16 also includes random access memory (RAM) 30 which is used to store some of the basic routines for booting computer hardware 16, as well as other common functions of main processing unit 26. Computer hardware 16 also includes user interface devices such as a video display, a speaker and/or a keyboard. Each of these user interface devices also includes respective controllers for controlling the transmission of the required data for properly utilizing the user interface devices.

Figure 6:
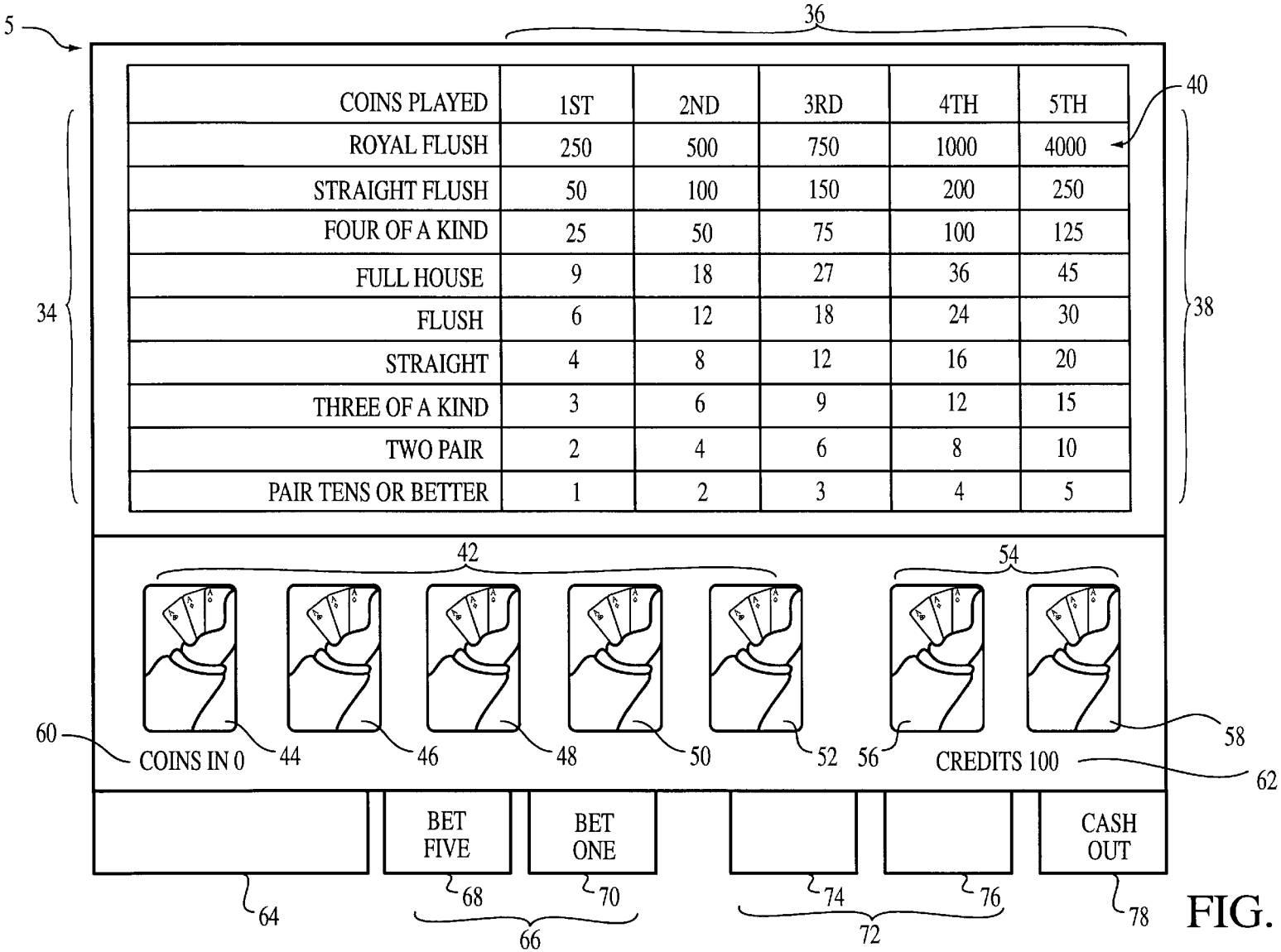
FIGS. 6–12 are illustrations of the interactive user interface according to a first design used when playing the modified poker card game and when the player loses the game.

FIG. 6 is an illustration of the user interface display in accordance with a first design layout in the modified poker game computer system. In FIG. 5, display area 5 includes winning card hands 34 which describes the card hands which the player will win in the modified poker card game. Coin/token column indicator 36 displays the specific payoff or award when 1–5 coins/tokens are entered in the modified poker computer game. Each column represents a specific number of coins/tokens that have been entered. Payoff or prize table 38 lists the specific prize awarded to the player for each specific winning card hand in accordance with the number of coins/tokens that have been wagered or played. Note that in payoff/prize table 38, a special bonus prize 40 is provided when the player obtains a royal flush card hand with five coins/tokens being played. This bonus prize 40 provides the incentive for the player to wager or play five coins for a specific round or game of modified poker card.

Of course, other payoff tables may also be used. For example, we have advantageously developed a new payoff table that provides several significant advantages over conventional payoff tables. See, for example, U.S. Pat. Nos. 5,437,451; 5,382,025; 5,225,915; and 4,948,134, all of which are hereby incorporated herein by reference as examples of standard payoff tables.

On the other hand, there have also been prior attempts at altering the standard payoff table without successful results. For example, in U.S. Pat. No. 5,415,404, the payoff table has been altered by awarding the player with the same return for either "Jacks or Better" and "Two Pair." However, this severely distorts the payoffs/awards not in accordance with the appropriate probabilities. That is, over 80% of the card hands according to this revised table do not ever win to provide the higher payoffs for the more difficult card hands.

According to our new payoff table in FIGS. 15–18, the first level of winning, for example in the payoff table-a pair of jacks or better, only provides half the investment or wager (i.e., an amount less than the original wager/investment), thereby providing additional winnings for the game operator. These additional winnings can then advantageously be distributed to other winning hands that have not traditionally been awarded in accordance with or on par with the associated probability for obtaining such a hand. Thus, for example, with respect to the payoff tables in FIGS. 15–18, the winning hands that have an increased payoff schedule include, for example, a straight, a flush or a full house. The reason why these hands have increased returns is that the initial or lowest payoff for the player has been reduced from an even payoff, 1-1, to a less payoff, e.g., 2-1.

This new payoff schedule provides the following benefits. First, the new payoff table provides a more realistic poker or modified poker card game award in accordance with the associated probabilities. For example, in FIG. 16(*a*), a Straight receives a return of 6 to 1, Two Pair receives a return of 1.5 to 1, and Jacks or Better receives a return of 0.5 to 1. Thus, there is the appropriate award for the player responsive to the according probabilities.

A second benefit we have realized is that in the past, players would not attempt to form a card hand when the award was not commensurate with the card hand's probability. Thus, a player would prefer obtaining a lesser return because the card hand had a much higher probability of being obtained than a more difficult card hand that did not have a return commensurate with the associated probability. Thus, for example, we have determined that many players would not even attempt to form a Straight or Flush card hand because the associated reward was small (e.g., 3 or 4 to 1) in relation to the probability of forming same. Thus, players would generally attempt to form either Three of a Kind with a lower probability, or more difficult hands where the awards were much greater. The end result of our revised payoff table is that since the awards a re commensurate with the associated probability for forming the card hand, the only motivation for attempting to form a specific card hand related the players risk tolerance or desired award.

A third benefit we have discovered using our revised payoff table is that because less than an even award is provided for the first typically eligible card hand (e.g., Jacks or Better), the entire payoff table is easily manipulated to create higher awards without distorting other awards for other card hands having different probabilities. For example, compare the different payoff schedules between FIG. 15 and 16 for the same game of video poker.

A fourth benefit that we have realized that results from our revised payoff table is that the payoff table eliminates too many options for the player. In general, the playing/gaming industry favors providing players with less choices. The reason is that players tend to play more games and wager more when presented with less options. According to our revised payoff table, therefore, wagers of 2 or 4 units/coins are permitted, and preferred. This condensed payoff table, we have found, provides the player with less choices that are more valuable to the game controller or operator, i.e., an investment of 2 or 4 units.

In FIG. 6, player card area 42 includes the five player selected cards 44, 46, 48, 50 and 52, and the player has not yet selected any cards. Dealt card area 54 includes two cards, 56, 58, which are dealt to player for selection at each of the five rounds in the modified poker card game. The player then selects either card 56 or card 58 for each round. The selected card is then transferred to an appropriate area in player card area 42. For example, if the player is being dealt the third round of cards 56, 58 in dealt card area 54, the selected card will then be transferred to third card area 48.

Total coins/tokens played display area 60 identifies the amount of coins/tokens which are currently being played. Total player credit display area 62 displays the total amount of player credits that are available for playing one or more additional modified poker card games.

Start or deal button 64 is a button or touch screen area that begins the modified poker card game. Coins to be played buttons 66 are buttons or touch screen areas that allow the player to enter the number of coins to be played in the modified poker game computer system. For example, if the player wants to enter ten tokens for play, the player can press the "Bet Five" button 68 twice. On the other hand, if the player wants to enter three tokens for playing modified poker card, the player can press the "Bet One" button three times to enter the desired number of coins/tokens.

Once the player is dealt a pair of cards 56, 58 in dealt card area 54 for selection, the player selects card 56 or card 58 via pick or selection buttons 74, 76 in pick card area 72. For example, if the player wants to select the second card 58 in dealt card area 54, the player presses pick card button 76 which is directly below card 58. Similarly, the player wants to select card 56, the player presses pick card button 74. The player may only depress one of the pick card button 74 or 76 for each round of play. Finally, end button or touch screen area 78 ends the player's turn for playing the modified poker card game and returns all remaining credits to the player, i.e., the player cashes out of the modified poker card game.

Figure 7:
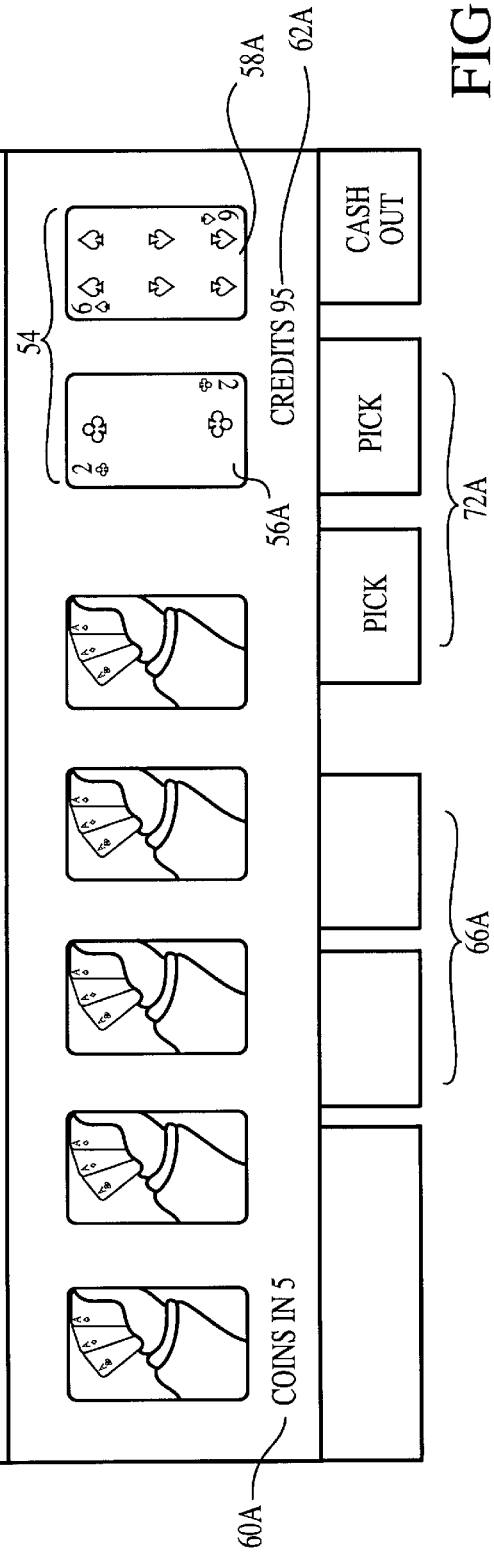

FIG. 7 illustrates the first round of play of the modified poker game computer system. In FIG. 7, the player has been dealt a first pair of cards 56A, 58A in dealt card area 54A. The player has also entered five coins or tokens for play in coin/token area 60A. The total remaining playing credits are therefore 95 (i.e., original 100 credits minus five credits being played), which is displayed in remaining player credit display area 62A. Since the player has already selected the number of coins or tokens to be played, the coins to be played buttons 66A are no longer illuminated. In addition, since the player must now select between cards 56A, 58A in dealt card area 54A, the pick or select card area 72A is illuminated.

Figure 8:
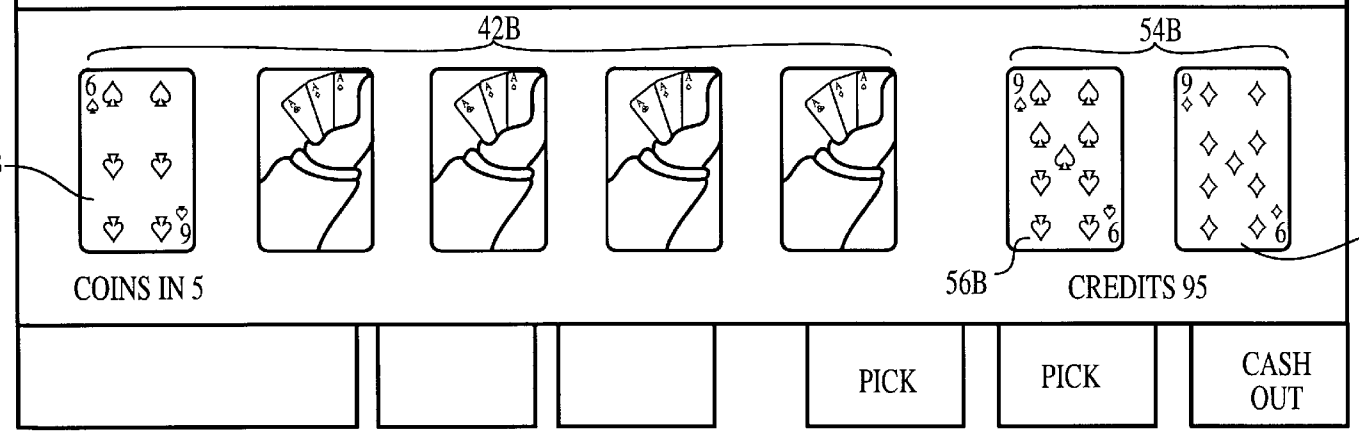

FIG. 8 is an illustration of the second round of the modified poker game computer system after the player has selected one card from the first pair of dealt cards illustrated in FIG. 7. In FIG. 8, the player has selected the six of spades for the first player card select area 44B in the player card select area 42B. In addition, the player has been dealt a second pair of cards 56B and 58B in the dealt card area 54B for selection.

Figure 9:
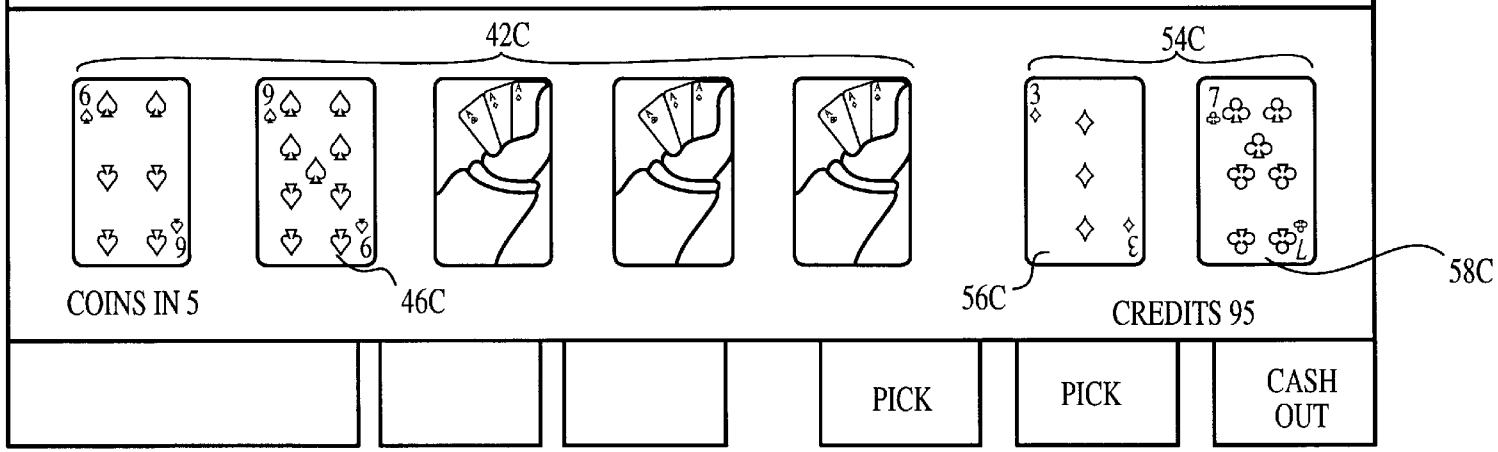

FIG. 9 is an illustration of a third round of the modified poker game computer system where the player has selected a second card from the second round illustrated in FIG. 8. In FIG. 9, the player has selected a nine of spades from the pair of cards dealt in the second round which is illustrated in the second player card selected area 46C of the overall player card area 42C. In addition, the player has been dealt a third pair of dealt cards 56C and 58C in the dealt card area 54C.

Figure 10:
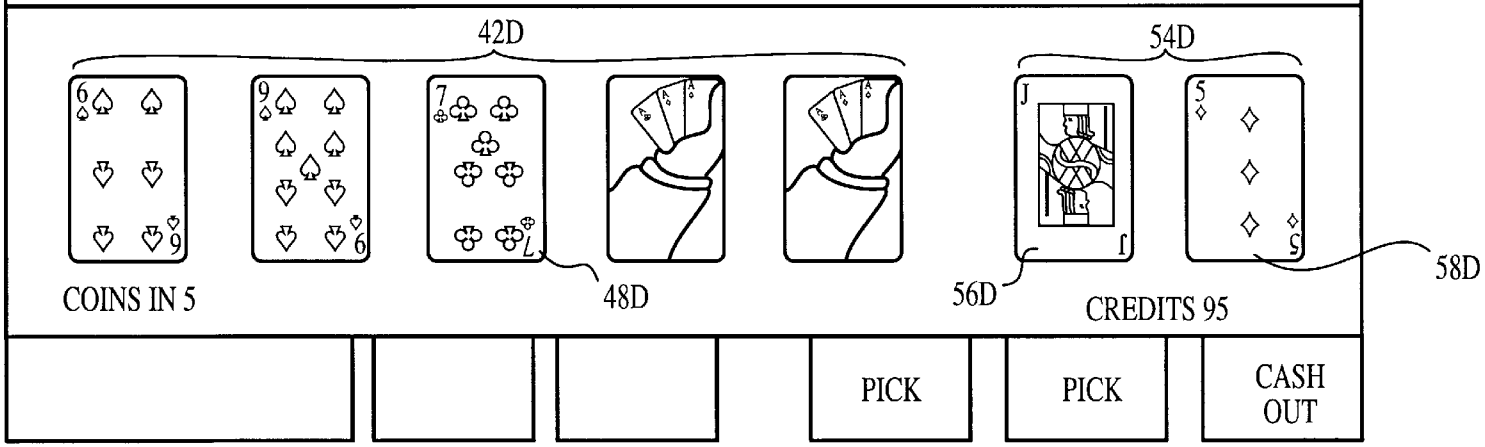

FIG. 10 is an illustration of a fourth round of the modified poker game computer system where the player has selected a third card from the third round of the modified poker card game displayed in FIG. 9. In FIG. 10, the player has selected a seven of clubs which is displayed in the third card selected area 48D of the overall player card area 42D. In addition, the player has been dealt a fourth pair of dealt cards 56D and 58D in the dealt card area 54D.

Figure 11:
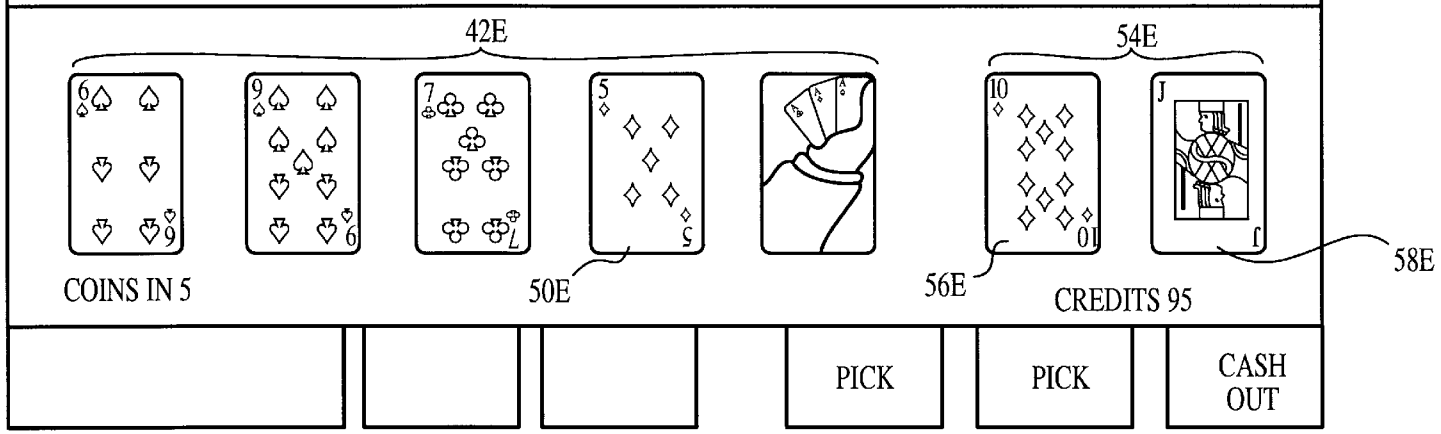

FIG. 11 is an illustration of the fifth round of the modified poker game computer system where the player has selected a fourth card from the fourth round of the modified poker card game illustrated in FIG. 10. In FIG. 11, the player has selected a five of diamonds as the fourth card in the display area 50E of the overall player card area 42E. Since the player has not received any pairs of the same card of ten or higher, the player is now attempting to obtain a straight flush. The royal flush is no longer possible since the player has selected cards of more than one suit, i.e., spades, clubs and diamonds. In addition, the player has been dealt the fifth or last pair of cards 5E and 58E in the dealt card area 54E.

Figure 12:
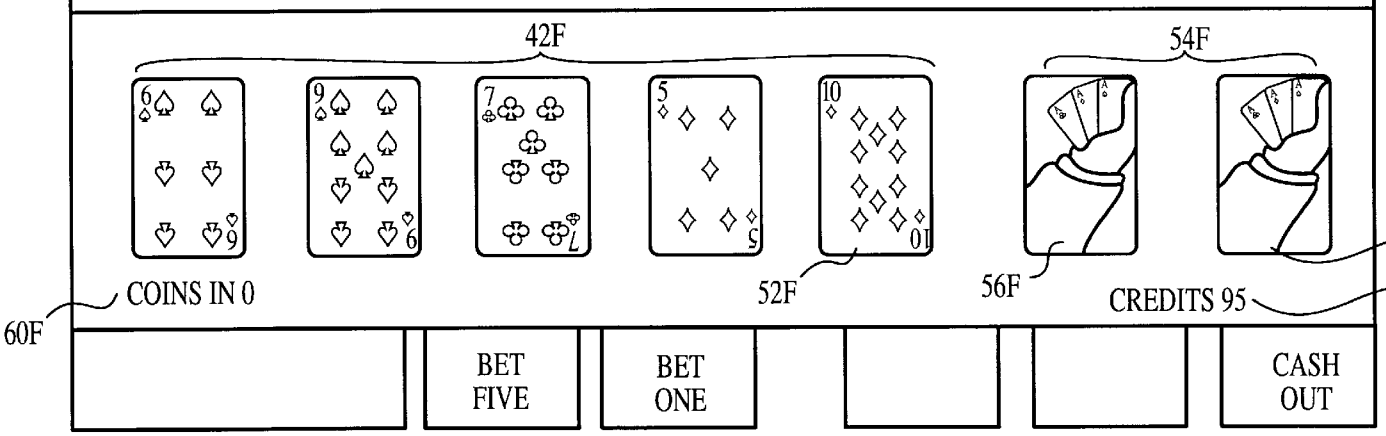

FIG. 12 is an illustration of the modified poker game computer system where the player has selected the fifth and final card from the fifth round of the modified poker card game illustrated in FIG. 11. In FIG. 12, the player has selected a ten of diamonds as the final card in selected card area 52F in the overall card area 42F. Note that no pairs of cards 56F, 58F have been dealt to the player in dealt card area 54F. Since the player has not obtained a pair of tens or better, the player has lost this modified poker card game. Accordingly, the total player credits remaining in display area 62F is 95. In addition, since the modified poker card game has been completed, the total coins/tokens that have been entered for play in coin/token area 60F is now 0. Since the modified poker card game has been completed, the tokens to be played buttons 66F are illuminated for beginning a new game, and the player card select button 72F is no longer illuminated.

Figure 13:
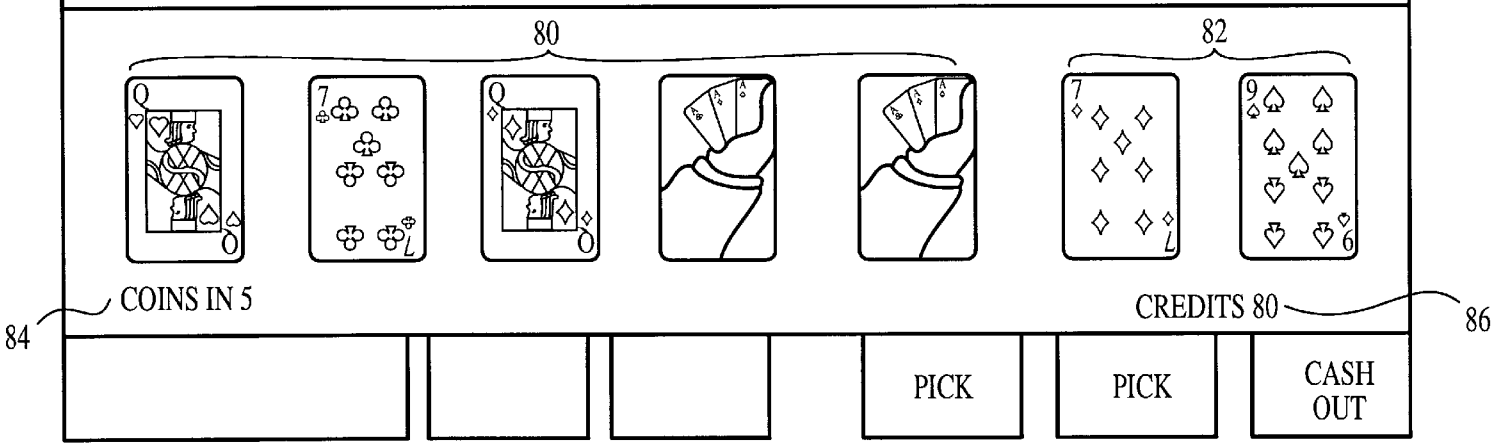
FIGS. 13–14 are illustrations of the interactive user interface in the modified poker card game when the player wins.

FIG. 13 is an illustration of a second modified poker card game in progress. In FIG. 13, the player has already been dealt three rounds of the modified poker card game, and has selected a corresponding three cards from the three pairs of cards previously dealt in the player card area 80, i.e., the queen of hearts, a seven of clubs and a queen of diamonds. In addition, the player has been dealt a fourth pair of cards in dealt card area 82, i.e., a seven of diamonds and a nine of spades. Note that for this game, the player has entered five coins or tokens in coins/tokens display area 84, and that the total player credits available for additional modified poker card games is 80 in player credit area 86. Since the modified poker card game is in progress, the coin/token enter buttons 88 are not illuminated, and the card select buttons 90 are illuminated for selecting one of the pair of cards displayed in dealt card area 82.

Figure 14:
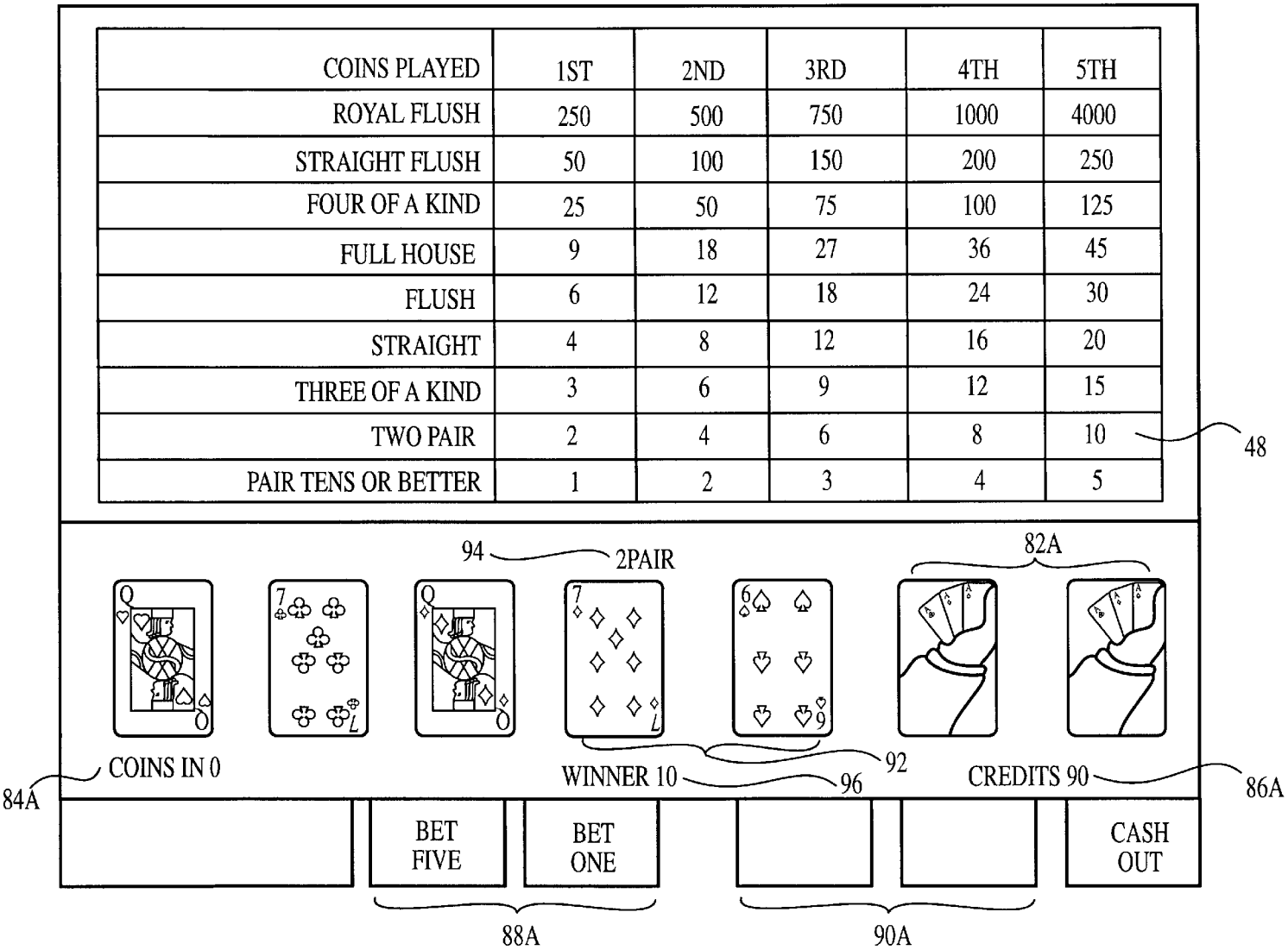

FIG. 14 is an illustration of the final player hand for the second computer game illustrated previously in FIG. 13. In FIG. 14, the player has selected the seven of diamonds from the fourth round of the modified poker card game illustrated in FIG. 13. In addition, the player has also selected a six of spades from the fifth round of the modified poker card game (not illustrated). The seven of diamonds and the six of spades are illustrated in the player card area 92. Since all cards have been dealt to the player, the dealt card area 82A is empty or inactive. In addition, since the game has been completed, the tokens or coins which are currently entered in the modified poker game computer system in area 84A is 0, the coin/token enter buttons 88A are illuminated, and the card select buttons 90A are not illuminated.

The player has won this game of modified poker by having two pairs, i.e., a pair of queens and a pair of sevens. The player is notified of the winning two pair card hand in area 94, and the winnings are displayed in area 96, i.e., the player entered five coins/tokens and doubled his/her tokens equaling ten, as also illustrated at area 98 of display 5. Finally, the remaining credits available are incremented by ten and the player credits available for additional game area 86A total now 90 credits that are available for further play and/or cash-out by the player.

The above description of the modified poker game with reference to FIGS. 6–14 are exemplary of the modified poker card game where the player selects a card from the pair of dealt cards and discards the remaining cards, leaving a single five card hand after all five rounds of the modified poker card game.

On the other hand, the modified poker card game can also be used to play two simultaneous five card hands. In this embodiment or version of the modified poker card game described above, the player selects a first card from the pair of dealt cards in each round for the first hand, and selects the second or remaining card from the pair of dealt cards for the second hand. The player may be considered to be the winner if either (1) the first hand contains, for example, a pair of 10's or better; and/or (2) the second hand contains, for example, a pair of 10's or better; and/or (3) the combination of the first and second hands contains, for example, two pair or better. Corresponding returns or prizes awarded for this game may also be developed in accordance with an appropriate probability table.

While the modified poker card game has been illustrated for implementation on a computer system, the modified poker card game can also be played in a casino environment as a table game where all players play against the house or casino, or where all players except one play against another player who is acting as the dealer or bank, as discussed above.

The modified poker card game therefore provides dynamic strategies during a single game in a fast paced and exciting setting. Accordingly, the modified poker card game requires players to make multiple decisions and provide exciting opportunities for dynamic strategies.

Tournament Modified Poker Card Game

The following is a description of the basic situations or game setups that apply to the modified poker card tournament game:

a) Adult Bar Game Tournaments—skill game for points or prizes (see Casino Tournaments below for payoffs).

b) Casino Tournaments—One to three session tournaments, played for large jackpots. The first session can be a qualifying round of ten to twenty deals. The same ten to twenty deals are provided for all participants. That is, all players are offered the same pair of cards for each deal to choose one card for each hand.

The semi-finals and the finals will also consist of ten to twenty deals. The semi-final and final sessions should generally be used in large tournaments only to generate additional excitement since there will be a large jackpot.

Any number of players can enter the tournament. If the tournament is large enough, then some percent of the players may qualify for the semi-finals or finals. All prizes come from the jackpot entry bets made by the players. The house can also take a cut or fee for running the tournament. For example, the tournament payoff schedule could look like this:

Large Tournaments (more than 100)
- 8th place gets 2% of jackpot
- 7th place gets 3%
- 6th place gets 4%
- 5th place gets 5%
- 4th place gets 8%
- 3rd place gets 12%
- 2nd place gets 16%
- 1st place gets 40%

Smaller Tournaments
- 4th place gets 10% of jackpot
- 3rd place gets 15% of jackpot
- 2nd place gets 25% of jackpot
- 1st place gets 50% of jackpot Very Small Tournaments
- 2nd place gets 30% of jackpot
- 1st place gets 60% of jackpot
- house gets 10% for running tournament Each of the individual hands are scored based on a combination of the single unit bet column of the payoff table and on duplicate match point bridge scoring rules. For example, consider duplicate match point bridge scoring concepts. That is, two points are awarded for each player that is beaten, and one point for each player that is tied. Therefore, on where everyone is pulling a pair of Kings, someone can get a top score by getting triple-threes. Example: (K-3) (10-3) (K-7) (8-3) (3-5) yields a pair of Kings for almost all players except for the "crazy" few who pick the first 3-card!

This method of scoring is perfect for the modified poker card game tournament since there will be a great variation in the final five cards of each player. Remember that the same five pairs of cards offer thirty-two possible outcomes as the final hand.

Scoring Example and Analysis

Consider this deal: (♥K, ♦J) ♠K, ♦10) (♦8, ♣9) (♦9, ♠3) (♥3, ♣7)

with 50 participants in a tournament the frequency of some possible final hands are:

(1) ♥K ♠K ♣9 ♦9 ♣7frequency of occurrence 35

(2) ♥K ♠K ♦8 ♠3 ♥3frequency of occurrence 8

(3) ♥K ♠K ♦8 ♦9 ♣7frequency of occurrence 3

(4) ♦J ♦10 ♦8 ♦9 ♣7frequency of occurrence 3

(5) ♦J ♦10 ♣9 ♦9 ♣7frequency of occurrence 1

Scoring analysis players=(42×1)+8=50 points

The 8 players with hand (2) tie 42 players and beat 4 players=(42×1)+8=50 points The 3 players with hand (3) tie 2 players and beat 1 player=(2×1)+2=4 points The 3 players with hand (4) tie 2 players and beat 47 players=(2×1)+94=96 points The 1 player with hand (5) ties and beats no one=0 points.

Hands (1) and (2) are equivalent as defined by the payoff table and this is the only measure on hand. Tournament entry fees can be of any amount. That is, while some players are putting up ten dollars, other players can put up other amounts. In essence, what is occurring is that simultaneous tournaments are being run—with participants overlapping from one tournament to another.

For example, let us assume that one hundred players wish to participate in a multi-layered tournament—with the following distribution of tournament jackpot entry fees:

50 players at $10

30 players at $25

15 players at $50

5 players at $100

Therefore there will be four concurrent pots with:

100 players at $10 each for a $1,000 pot (all players)

50 players at $25 each for a $750 pot (30 players at $25, the 15 at $50, the 5 at $100)

20 players at $25 each for a $500 pot (the 15 players at $50 and the 5 players at $100)

5 players at $50 each for a $250 pot (the 5 players who put up $100) After x deals (where x=10 or 20, for example), each group is independently scored by the above method. That is, scoring is comparative to only those players within each group.

For example, a player who has put up $100 will be scored comparatively in the four separate groups. The player may not qualify within the largest group, but may find himself winning within a smaller higher level group. Essentially, this method provides separate pots because for the higher stakes pot only some of the players are "all in," and a separate pot applies for all those players who are not "all in" the previous pot but who have entered the tournament.

SUMMARY OF FEATURES OF TOURNAMENT a) There is no restriction to the number of participants.

b) In addition, the number of participants does not have to be "a magic number", such as 64 or 128 or . . .

c) The participants can wager any denomination, since scoring is based not on absolute winnings, but, relative winnings to the payoff table. Therefore, a tournament can have a mixture of denominational participants.

d) The participants will actually win the full value of any hand that they create, at their individual machine. Thereby giving this tournament the best of both worlds—a duplicate bridge flavor for fairness and a rubber bridge flavor for full value winning.

e) The tournament consists of many deals giving the participants full value for their entry fee.

f) The prize money is large, that is, the return on investment is high.

g) The game itself is the underlying reason why this type of tournament succeeds. It has a natural bifurcation of hands that can be created, which will quickly separate the field, by the scoring method used.

Special Features of Modified Poker Card Game Tournament a) Since this is a duplicate concept—the decision on each pair of cards must be completed by all participants prior to exposing the next pair. That is, to avoid any possibility of collusion or cheating, all players must be on the same timetable. No one can see the next pair before all players make their decision on the current pair. Therefore, a time concept must be used, whereby a player must move within a time limit or the move will be made from him—by the machine.

b) Office Tournaments—team play, that is, office section vs. another section. Also individual statistics.

c) Home Play Tournaments—keep score.

Variants of Modified Poker Card Game Tournament a) Splitting: Instead of choosing one card of the pair being offered—the player can split his hand by doubling his bet, and therefore, taking both cards as part of two different poker hands. For example, if the player has reached a three card hold of ♣K, ♣Q, ♣J) and the offered pair is (♣10 or ♦K), then it would behoove the player to split and double his bet to have both possible hands, that is: (♣K, ♣Q, ♣J, ♣10) and (♣K, ♣Q, ♣J, ♦K) since each hand can be a winner.

Subsequent card pairs may offer no option, and the card chosen must go to both hands, or alternatively, the card pair may be split and one card used for each hand. For example, in the above example, if the four of clubs is chosen, then the player ends up with a flush in one hand and a pair of kings in the other.

Of course, there must be a premium to pay for this privilege since the player can be a guaranteed winner. One suggestion is, that to have the right to split requires the payment of an extra unit before any of the cards are dealt. For example, if the player plays six units (five units are the bet and one unit is for the opportunity to split) he can split by wagering an additional five units. All payoffs use the normal table. If the split option is not used, the unit is lost since it is not part of the player's wager. That is, if the player wins a payoff, the unit used for the split option is not considered in choosing the payoff column.

If the extra payment concept is used for splitting, that same payment concept can also allow for passing or taking both cards or replacement. (See options below.) That is, the extra unit bet may allow a player one optional play per game.

b) Passing Option: allows the player to Pass Up the pair offered and in effect get to see six pairs of cards to choose the five cards of a poker hand. For example, if the player's holding after three cards is (♠10, ♠9, ♠8) and the offered pair is (♣3, ♥2), the Pass Option allows the player to Pass on the Offered Pair and see another Offered Pair in order to choose the fourth card of the hand.

c) Take Both Cards Option: allows the player to Take Both Cards of the Pair Offered and in effect get to see only four pairs of cards to choose the five cards of a poker hand. This option is not available as a fifth card option. For example, if the player's holding after three cards is (♣9, ♠9, ♣6) and the offered pair is (♠9, ♥6), the Both Card Option allows the player to have both cards offered to complete a full-house and not be offered a fifth pair to choose from.

d) Replacement Option: allows the player to replace a card in the hand with a card from the offered pair, and in effect, get to see six pairs of cards to choose the five cards of a poker hand. For example, if a player's hand after three cards is ♠K, ♥7, ♠J) and the offered pair is (♠10, ♦Q) with the Replacement Option the player can choose to replace the ♥7 with the ♦Q, thereby holding (♦K, ♦Q, ♦J) and having two more pairs of cards to choose from.

One form of software and hardware architecture that may be used to implement the modified poker card tournament is found in copending provisional patent application to Howard M. Marks et al. filed on Feb. 13, 1996, Ser. No. 60/011,574, the details of which are incorporated herein by reference. Alternatively, the specific software used to implement this tournament version is included in the Appendix of copending provisional patent application to Anthony M. Singer, et al., filed on Jun. 14, 1996, Ser. No. 60/019,747, and the software/hardware described in detail in copending patent application to Anthony M. Singer, et al., filed on Sep. 19, 1996, Ser. No. 08/716,114, the details of which are incorporated herein by reference.

Thus, the above description illustrates the exciting aspects of the modified poker card game. It has the same feel as video poker, the same speed, same knowledge, and some of the same number of decisions.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of playing a card game wherein a player sequentially builds a card hand after each round of play, comprising the steps of:

(a) dealing a set essentially consisting a pair of cards at a dealing to the player;

(b) selecting one of the pair of cards for the card hand, and discarding a second of the pair of cards;

(c) repeatedly performing steps (a) and (b) until the player has selected a predetermined number of cards that comprise the card hand; and (d) comparing the card hand to a predetermined winning schedule and/or to other players playing the card game.

2. A method of playing a card game according to claim 1, further comprising the steps of:

(e) playing the card game with at least two players in a tournament game; and (f) scoring each of the players card hands based on a single unit bet column of a payoff table using duplicate bridge match point scoring rules to determine a winner for the tournament game.

3. A method of playing a card game according to claim 1, further comprising the steps of:

(e) playing the card game with at least two players in a tournament game; and (f) scoring each of the players card hands to determine a winner for the tournament game.

4. A method of playing a modified poker card game wherein a player sequentially builds first and second card hands after each round of play, comprising the steps of:

(a) dealing a set essentially consisting of a pair of cards at a dealing to the player;

(b) selecting one of the pair of cards for the first card hand, and selecting another of the pair of cards for the second card hand;

(c) repeatedly performing steps (a) and (b) until the player has selected a predetermined number of cards for each of the first and second card hands; and (d) comparing the first and second card hands, together or independently, to a predetermined winning schedule.

5. A modified poker game wherein a player sequentially builds a card hand after each round, comprising:

(a) means for dealing a set essentially consisting of a pair of cards at a dealing to the player;

(b) means for selecting one of the pair of cards for the card hand, and discarding the other card;

(c) means for repeatedly performing steps (a) and (b) until the player has selected a predetermined number of cards that comprise the card hand; and (d) means for comparing the card hand to a predetermined winning schedule.

6. A modified poker game according to claim 5, further comprising:

(e) means for playing the card game with at least two players in a tournament game; and (f) means for scoring each of the players card hands based on a single unit bet column of a payoff table using duplicate bridge match point scoring rules to determine a winner for the tournament game.

7. A method of playing a card game wherein at least one player sequentially builds a card hand after each round of play, comprising the steps of:

(a) dealing a set essentially consisting of at least two cards but less than a predetermined number of cards that comprise the card hand at a dealing to the at least one player;

(b) selecting zero cards, or at least one of the at least two cards for the card hand, and discarding either zero cards, or at least one of the at least two cards, or the two cards;

(c) repeatedly performing steps (a) and (b) until the player has selected the predetermined number of cards that comprise the card hand; and (d) comparing the card hand to a predetermined winning schedule and/or to other players playing the card game.

* * * * *